US006135521A

United States Patent [19]

Wirth, Jr. et al.

[11] Patent Number: 6,135,521

[45] Date of Patent: Oct. 24, 2000

[54] PUSH STICK

[75] Inventors: John Wirth, Jr., Dubois; Jay L. Sanger, Casper; Paul Brutsman, Casper; Mark McCool, Casper, all of Wyo.

[73] Assignee: Woodworker's Supply Inc., Casper, Wyo.

[21] Appl. No.: 09/191,195

[22] Filed: Nov. 13, 1998

[51] Int. Cl.[7] ..... B27B 25/10

[52] U.S. Cl. ..... 294/15; 83/436.2

[58] Field of Search ..... 294/1.1, 2, 9, 10, 294/12–15, 17, 24, 26, 27.1; 16/411, 421, 430, 431; 83/68, 435.15, 436.2, 438, 478; 144/242.1, 251.1; 269/315

[56] References Cited

U.S. PATENT DOCUMENTS

| | | | |
|---|---|---|---|
| 1,188,167 | 6/1916 | Foucart | 294/26 |
| 2,410,467 | 11/1946 | Valentine . | |
| 2,839,100 | 6/1958 | Valicenti . | |
| 4,001,903 | 1/1977 | Hay . | |
| 4,348,925 | 9/1982 | Manweiler . | |
| 4,370,909 | 2/1983 | Jennings . | |
| 4,485,711 | 12/1984 | Schnell . | |
| 4,603,612 | 8/1986 | Atkins . | |
| 4,962,685 | 10/1990 | Hagstrom . | |
| 5,016,509 | 5/1991 | Stottman . | |
| 5,018,773 | 5/1991 | Stavin et al. | 294/1.1 |
| 5,293,800 | 3/1994 | Nunn | 83/436.2 |
| 5,301,726 | 4/1994 | Wojcik . | |
| 5,678,467 | 10/1997 | Aigner | 83/436.2 |
| 5,781,956 | 7/1998 | Kelsay et al. | 16/430 X |
| 5,894,777 | 4/1999 | Sterling | 83/436.2 |

*Primary Examiner*—Johnny D. Cherry
*Attorney, Agent, or Firm*—Nixon & Vanderhye PC

[57] ABSTRACT

A push stick for use with woodworking equipment is provided with a main body having two stepped portions or notches for positive engagement with a work piece. The push stick has an ergonomically designed, open grip handle and non-slip pads on working surfaces for control and ease of use.

22 Claims, 3 Drawing Sheets

PUSH STICK

BACKGROUND OF THE INVENTION

1. Field of the Invention

The present invention relates to a versatile, ergonomic push stick capable of securely engaging and advancing a work piece over or through wood working equipment.

2. Description of the Related Art

In wood working operations involving equipment such as table saws, routers, planars, jointers and the like, a push stick is typically used to advance the work piece through the equipment, past the cutting tool, to prevent accidental injuries to the fingers and hands. A push stick also helps to control the work piece, to maintain dimensional tolerances. A typical push stick is simply a notched stick that is engaged with the rear edge of the work piece and used to push the work piece through the wood working equipment.

An example of such a conventional push stick is disclosed in U.S. Pat. No. 4,001,903. This design provides more protection and control than no push stick at all, but it provides only limited contact with the work piece and may be awkward to grasp. As a result, the wood piece may buck off the work surface of the wood working machine, the push stick may slip or disengage from the work piece, and/or the operator may lose his grip of the handle.

To address the deficiencies of this conventional push stick design, others have devised push sticks that provide a larger interface between the tool and the surface of the wood. For example, U.S. Pat. No. 4,348,925, discloses a push stick with an arched handle and an elongated main body portion to press against the working surface of the work piece. While this push stick may provide a greater contact area with the work piece, it is still lacking in other respects. For example, the arched handle is low and close to the main body, which keeps the operator's hands close to the main body of the pusher device and thus close to the work piece. Moreover, because the groove or notch for engaging the work piece is at the rear of the pusher whereas the handle is secured towards the front, the user's hand may closely approach the cutting tool, particularly when machining small work pieces.

Another pusher device is disclosed in U.S. Pat. No. 5,016,509. The main body of this device is also adapted to rest on the top surface of a work piece to press the work piece against the work surface, thereby maintaining the piece under control as it is pushed past/through the cutting tool of the wood working machine. A straight edged, inclined handle projects from the rear of the unit. This particular pusher device also provides, in combination with the pusher feature, a tool for performing several measuring operations. While the higher handle of this tool keeps the operator's hand above and away from the cutting tool, the straight edged grip does not allow for firm comfortable gripping of the handle. Moreover, the hand opening is provided at a predefined location and elevation. Thus, the pusher device cannot be freely gripped at the position most comfortable for the operator's wrist.

Thus, while the U.S. Pat. No. 5,016,509 design is more stable than the conventional push stick, it has limited versatility. There is a longer handle to grip the pusher device, but only one way to grip the handle. Additionally, because of the variety of measurement components provided, the tool is rather bulky and may preclude a close approach to the cutting blade when working with small work pieces.

SUMMARY OF THE INVENTION

Therefore, it is an object of this invention to provide a push stick of the above general type but which more securely engages and grips the work piece as it is advanced through a cutting implement. The foregoing and other objects are achieved in accordance with the present invention by providing a push stick comprising a main body that has at least one stepped portion, with at least one slip resistant pad secured to a working surface of the stepped portion, and a handle component extending upwardly from the main body.

It is a further object of the invention to provide a push stick which can be used for the machining of both small and large work pieces. The foregoing and other objects are achieved in accordance with the present invention by providing a push stick comprising a main body with first and second stepped portions, each including a generally flat working surface and an abutting surface inclined with respect to the working surface, and a handle component extending from the main body.

Yet another object of the invention is to provide a push stick having a handle which allows the operator to firmly and comfortably grip the handle and which keeps the operator's hand up and away from the blade of the wood working equipment. The foregoing and other objects are achieved in accordance with the present invention by providing a push stick comprising a main body having at least one stepped portion, and a handle projecting vertically upwardly from adjacent the proximal end of the main body, the handle being substantially continuously curved in an arc shape and extending towards the distal end of the main body, and the handle having a free end disposed vertically above the main body and spaced from the main body by a distance of greater than about a half of a length of the main body.

Additionally, it is an object of the invention to eliminate unnecessary bulk so as to provide a push stick that is light weight and convenient to use.

These and other objects and advantages of the present invention will become clearer after careful consideration is given to the following detailed description of the preferred exemplary embodiments thereof.

BRIEF DESCRIPTION OF THE DRAWINGS

Reference will hereinafter be made to the accompanying drawings wherein like reference numerals throughout the various figures denote like structural elements, and wherein.

DETAILED DESCRIPTION OF THE PREFERRED EMBODIMENT

Figure 1:
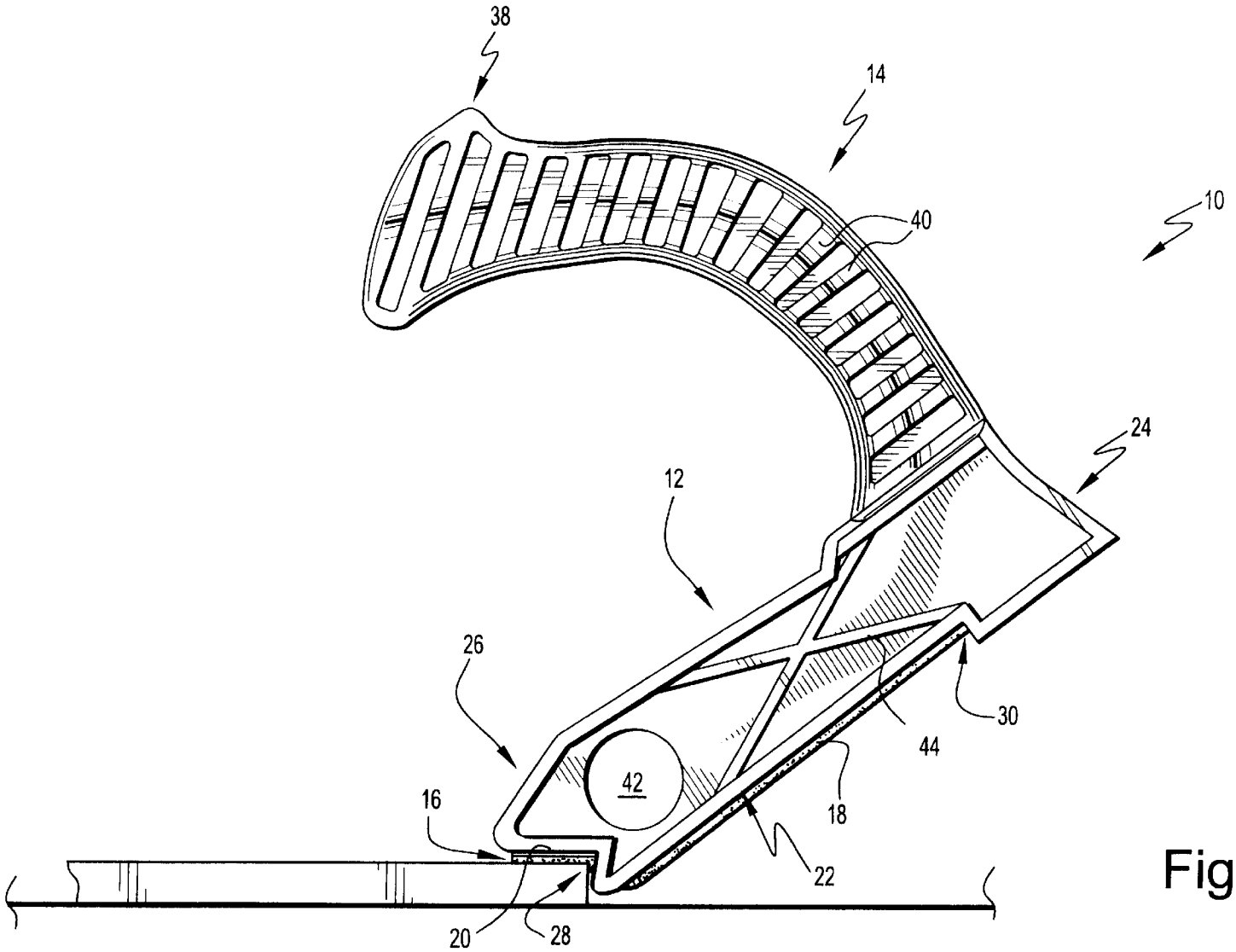
FIG. 1 is a side elevational view of a push stick provided in accordance with a preferred embodiment of the invention, showing a work piece engaged by a first stepped portion thereof.

It is one of the objects of the present invention to provide a push stick which securely engages the work piece as it is advanced through a cutting tool, to provide a stabilizing function. In accordance with this object of the present invention, a push stick 10 has a main body 12 having a handle 14, and a friction enhancing material 16, 18 secured to working surface(s) 20, 22 of the push stick main body 12. The working face(s) are the undersurface(s) of the push stick main body 12 that are adapted to face a work piece upper surface.

For reference, the push stick main body 12 has a proximal end 24 adjacent the base of the handle 14, a distal end 26 opposite proximal end 24, and a longitudinal axis extending the length of the main body 12. The push stick main body 12 is preferably molded from a co-polymer plastic material whereby the push stick is light weight yet durable and corrosion proof. In addition, the use of a co-polymer plastic prevents blade damage should the push stick accidentally come into contact with the cutting implement. This feature is important in that it saves the replacement cost of the cutting implement which can be quite expensive. The co-polymer plastic also prevents the push stick 10 from fragmenting and the attendant risk of having shrapnel thrown back at the operator should the push stick accidentally engage the cutting implement.

Figure 2:
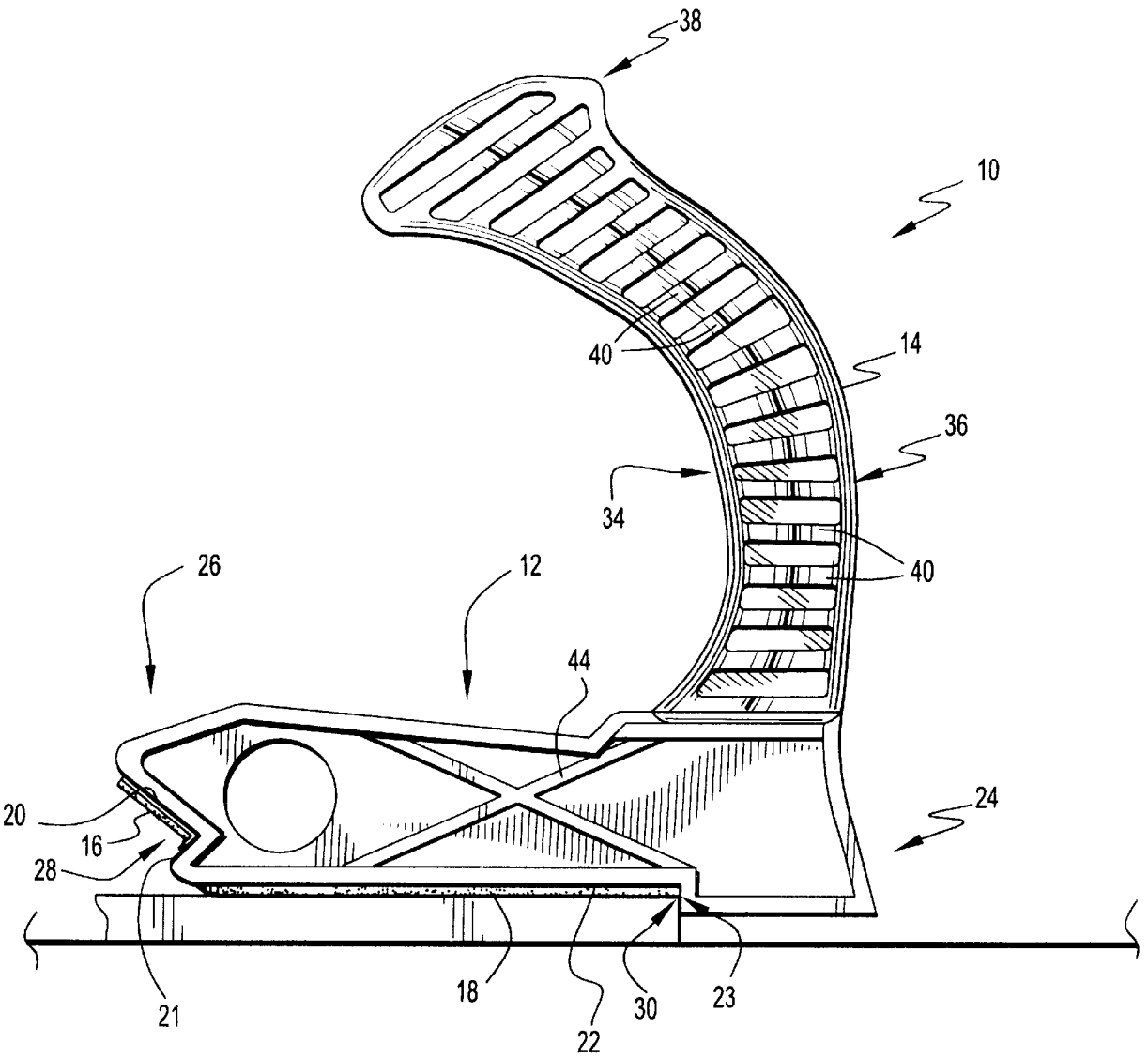
FIG. 2 is a side elevational view of the push stick of FIG. 1, showing a work piece engaged by a second stepped portion thereof.
Figure 3:
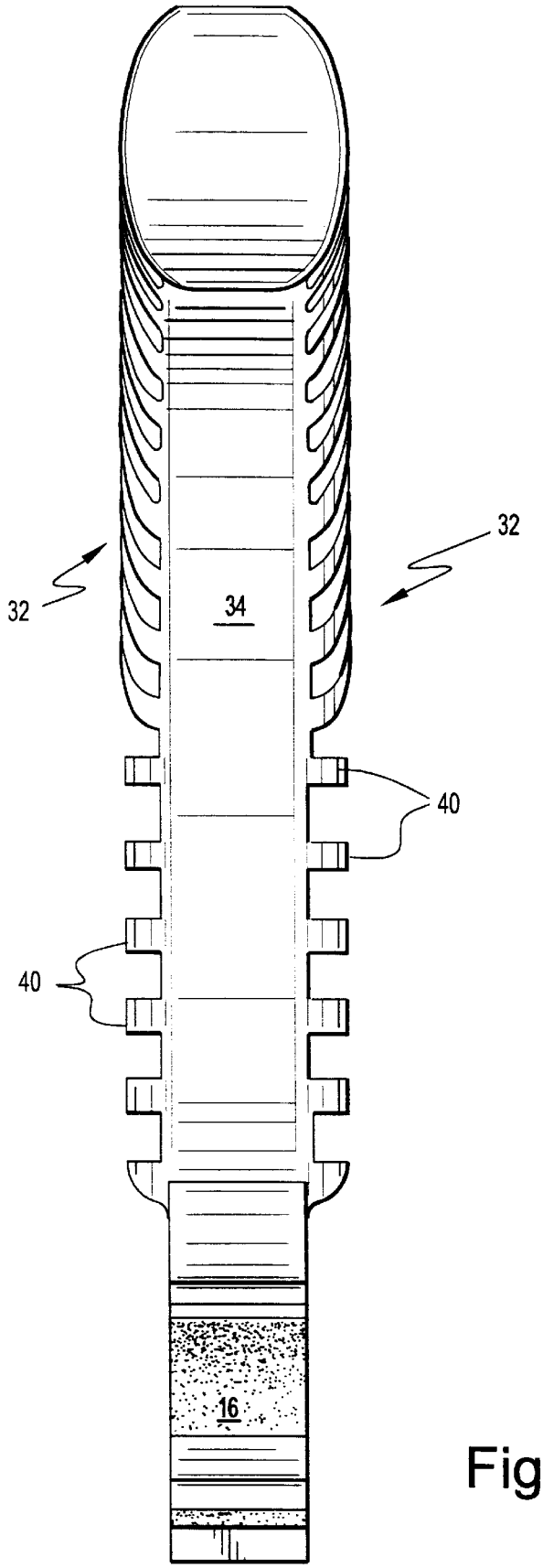
FIG. 3 is a front elevational view of the push stick of FIG. 1 with the work piece omitted.

With reference to FIGS. 1 and 2, in the illustrated, preferred embodiment, the main body defines two work piece engaging notches or stepped portions 28, 30 for selectively positively engaging a trailing edge of the work piece in order to advance the work piece through the blade of the wood working equipment. As shown in FIG. 1, to provide for controlled advancement of small work pieces, notch 28 is provided adjacent the distal end of the main body. The notch 28 includes working surface 20 and an abutting or step surface 21. The short axial length of the push stick in the orientation shown in FIG. 1 allows the operator to closely approach the cutting blade. The arched handle 14 allows the operator to comfortably and conveniently grip the tool while maximizing the contact force between the tool and the work piece and keeps the hand above and away from the cutting tool.

As shown in FIG. 2, for better control of large work pieces, second notch 30 is provided proximally of notch 28. Similarly to notch 28, notch 30 includes working surface 22 and an abutting or step surface 23. Notch 30 is preferably provided adjacent the proximal end 24 of the push stick main body 12. This maximizes the contact area between the push stick and the work piece and allows the operator to press down on the work piece during the cutting operation to maintain proper position and control of the work piece. Note that the arched handle 14 again allows the operator to comfortably and conveniently grip the tool from above, away from the cutting tool or blade. Furthermore, the configuration of the handle advantageously translates the pushing force applied by the user into both a forward, advancing force and a downward, work piece engaging force. As the user pushes the device, the bottom of the device is forced into the work piece. Moreover, the ergonomically-designed handle 14 enables precise, comfortable control and keeps the hand up and away from the blade in both working dispositions of the device.

To augment the gripping of the work piece by the device, for increased control and to avoid slip, the working surfaces 20, 22 of the main body 12 are preferably provided with a friction enhancing configuration or material. In the illustrated embodiment, no-slip pad(s) 16, 18 are provided, attached to the working surfaces 20, 22 of the push stick main body 12. Pads 16, 18 are preferably made from a low elastomer plastic, for example, DYNAFLEX G7940 manufactured by the GLS Corporation. Use of a low elastomer plastic is preferred because it will not scratch or otherwise damage the exposed surface of even the softest woods.

While in the preferred embodiment, the pads 16, 18 are smooth pads provided full length and full width of the respective working surfaces 20, 22 of the push stick main body 12, it is also possible, although less desirable, to provide discrete pads or strips of a rubbery material on the respective working surfaces. While the friction enhancing material pads may be adhesively secured to the push stick main body, in the presently preferred embodiment, pads 16, 18 are overmolded to the molded push stick main body 12. When the non-slip rubber material is joined to the bottom of the tool in this way during the molding process, the pads become integral with the main body of the tool, so they won't come off like glued-on pads, even after prolonged use.

As noted above, the push stick 10 provided in accordance with the present invention provides an arched, easy to grip and hold, ergonomically-designed handle 14. Advantageously, then, in the illustrated embodiment, the side walls 32 of the handle 14 are bowed whereas the front and rear surfaces 34, 36 of the handle 14 are generally flat. In this way the handle can be comfortably gripped, e.g. without pressure points from sharp edges, but the flat surface(s) avoid unintended rotation of the hand relative to the handle. As can be seen, to prevent the user's hand from slipping off the top, free end of the handle, the top end of the handle is preferably enlarged, for example by providing a protrusion or bulbous portion 38 to limit or obstruct vertical displacement of the hand.

To provide for an ergonomic configuration without adding undesirable weight and material costs, and at the same time providing a textured gripping surface for increased control, in the preferred embodiment the handle grip is defined by a plurality of lateral flanges 40. It should be noted that the provision of lateral flanges allows the three dimensional ergonomic handle 14 to be injection molded in one piece with the main body 12. It is possible, although presently considered less desirable, to provide a handle with a configuration other than the ladder-like lateral flange structure shown and/or to provide the handle as a separate component that is attached to the main body 12 after forming.

As noted above, the handle 14 of the push stick 10 of the present invention is generally continuously curved, vertically upwardly in an arch from adjacent the proximal end of the main body 12. This unique open design of the handle 14 permits the operator to quickly and easily grasp the handle 14, in either working orientation. Additionally, the open design of the push stick 10 is geometrically advantageous. The handle preferably extends forwardly, towards distal end 26 such that it extends over at least about half of the length of the main body, and preferably about two-thirds of the length of the main body, to ensure a downward pressing force component and the attendant work piece control. Also, the handle 14 preferably extends sufficiently upwardly, above the main body such that the user's hand can easily grasp the handle, preferably at more than one vertical elevation therealong. In the illustrated embodiment, the main body has a length of about 7–9 inches and the handle free end is disposed about 4 to 5 inches above the top of the main body. This relatively high arch of the handle 14 keeps the operator's hand up and away from the cutting blade of the wood working equipment, for added safety, and up and away from the work piece, so as not to obstruct the operator's view thereof, yet is not so remote from the work piece as to compromise control. Furthermore, the elongated open arc handle design acts as a torque arm, maximizing contact pressure applied to the work piece during advancement, to minimize bucking or shifting thereof.

As shown in FIGS. 1 and 2, in accordance with a further feature of the preferred embodiment an oversized hole 42 is defined adjacent the distal end of the push stick main body 12. The oversized hole 42 allows the tool to be easily hung from e.g. the large handles of a table saw, so that it can be stored near where it is to be used, and can not be forgotten or overlooked.

Finally, a structural cross rib 44 is at a midpoint of the push stick main body 12 for reinforcing the same without undesirable added bulk and in a manner consistent with injection molding.

While the invention has been described in connection with what is presently considered to be the most practical and preferred embodiments, it is to be understood that the invention is not to be limited to the disclosed embodiments, but on the contrary, is intended to cover various modifications and equivalent arrangements as will be appreciated by those of skill in the art to which it pertains.

What is claimed is:

1. A push stick device for displacing a work piece relative to woodworking equipment, comprising:

a main body having a proximal end, a distal end and a longitudinal axis, first and second stepped portions being defined in said main body, a first of said stepped portions being defined adjacent said disal end of said main body and including a generally flat first working surface and a first abutting surface inclined with respect to said first working surface, said second stepped portion being defined proximally from said first stepped portion, said second stepped portion including a generally flat second working surface and a second abutting surface inclined with respect to said second working surface; and a handle component extending from said main body whereby when said second working surface is disposed in parallel facing relation to a top surface of a work piece, said handle component is disposed predominantly vertically above said main body.

wherein said first working surface is disposed in a plane inclined at an angle of less than 90° and greater than about 0° relative to said longitudinal axis of said main body.

2. A push stick device according to claim 1 wherein said second working surface extends in a direction generally parallel to said longitudinal axis of said main body.

3. A push stick device according to claim 1, wherein said first working surface is disposed in a plane inclined at about 45° with respect to a plane of said second working surface.

4. A push stick device according to claim 1, further comprising at least one slip resistant pad secured to at least one of said first and second working surfaces.

5. A push stick device according to claim 4, wherein said at least one pad is over-molded to said main body.

6. A push stick device according to claim 4, wherein said pad extends so as to cover substantially an entirety of each of said first and second working surfaces.

7. A push stick device to claim 4, wherein said at least one slip resistant pad is formed of a low elastomer plastic.

8. A push stick according to claim 1, wherein said handle component extends vertically upwardly in a forward facing arc from said proximal end of said main body.

9. A push stick device according to claim 1, wherein said handle component comprises a plurality of laterally projecting flanges.

10. A push stick device according to claim 9, wherein said laterally projecting flanges have generally continuously curved free edges.

11. A push stick device for displacing a work piece relative to woodworking equipment comprising:

a main body having a proximal end, a distal end and a longitudinal axis, first and second stepped portions being defined in said main body, a first of said stepped portions being defined adjacent said distal end of said main body and including a generally flat first working surface and a first abutting surface inclined with respect to said first working surface, said second stepped portion being defined proximally from said first stepped portion, said second stepped portion including a generally flat second working surface and a second abutting surface inclined with respect to said second working surface; and a handle component extending from said main body whereby when said second working surface is disposed in parallel facing relation to a top surface of a work piece, said handle component if disposed predominantly vertically above said main body, wherein said handle component extends vertically upwardly in a forward facing are from said proximal end of said main body.

12. A push stick device for displacing a work piece relative to woodworking equipment, comprising:

a main body having a proximal end, a distal end and a longitudinal axis, first and second stepped portions being defined in said main body, a first of said stepped portions being defined adjacent said distal end of said main body and including a generally flat first working surface and a first abutting surface inclined with respect to said first working surface, said second stepped portion being defined proximally from said first stepped portion, said second stepped portion including a generally flat second working surface and a second abutting surface inclined with respect to said second working surface; and a handle component extending from said main body whereby when said second working surface is disposed in parallel facing relation to a top surface of a work piece, said handle component is disposed predominantly vertically above said main body, wherein said handle component comprises a plurality of laterally projecting flanges, said laterally projecting flanges defining a discontinuous exterior gripping surface of said handle component, thereby to facilitate manual grasping of said handle component.

13. A push stick device according to claim 12 wherein said laterally projecting flanges have generally continuously curved free edges.

14. A push stick device for displacing a work piece relative to woodworking equipment, comprising:

a main body having a proximal end, a distal end and a longitudinal axis, at least one stepped portion being defined in said main body, said stepped portion including a generally flat working surface and a step surface inclined with respect to said working surface; and a handle component projecting vertically upwardly from adjacent said proximal end of said main body, said handle component being substantially continously curved in an arc shape and extending towards said distal end of said main body, wherein said handle component comprises a plurality of spaced apart flanges oriented generally transversly to a center line of said handle component and projecting laterally to define a discontinuous exterior gripping surface of said handle component.

15. A push stick device according to claim 14, wherein said handle component has a free end disposed vertically above said main body, said free end being spaced from said main body by a distance of greater than about a half of a length of said main body.

16. A push stick device according to claim 15 wherein said handle component includes a bulbous portion adjacent said free end thereof.

17. A push stick device according to claim 14 wherein said handle component terminates at a point corresponding to at least about one-half of the length of said main body.

18. A push stick device according to claim 17 wherein said handle component terminates at a point corresponding to about two-thirds of the length of said main body.

19. A push stick device according to claim 14, further comprising at least one slip resistant pad provided on said working surface.

20. A push stick device according to claim 19, wherein said at least one pad is over-molded to said main body.

21. A push stick device according to claim 19, wherein said pad extends so as to cover substantially an entirety of said working surface.

22. A push stick device according to claim 19, wherein said at least one slip resistant pad is formed of a low elastomer plastic.

* * * * *